US005593302A

United States Patent [19]

Althaus et al.

[11] Patent Number: 5,593,302

[45] Date of Patent: Jan. 14, 1997

[54] COMBUSTION CHAMBER HAVING SELF-IGNITION

[75] Inventors: Rolf Althaus, Kobe, Japan; Yau-Pin Chyou, Taipei, Taiwan; Franz Joos, Weilheim/Bannholz, Germany; Jakob J. Keller, Redmond, Wash.

[73] Assignee: ABB Management AG, Baden, Switzerland

[21] Appl. No.: 414,725

[22] Filed: Mar. 31, 1995

[30] Foreign Application Priority Data

May 19, 1994 [DE] Germany ..... 44 17 538.8

[51] Int. Cl.[6] ..... F23D 14/02

[52] U.S. Cl. ..... 431/353; 431/354; 431/350; 60/737

[58] Field of Search ..... 431/8, 9, 354, 431/350, 182, 353; 60/748, 737; 48/189.3, 189.4

[56] References Cited

FOREIGN PATENT DOCUMENTS

0321809A1 6/1989 European Pat. Off. .
2-21118 1/1990 Japan .

*Primary Examiner*—Carl D. Price
*Attorney, Agent, or Firm*—Burns, Doane, Swecker & Mathis, L.L.P.

[57] ABSTRACT

In a combustion chamber consisting essentially of an inflow zone (5) and a combustion zone (11) and having self-ignition, the inflow zone (5) has vortex generators (100), of which a plurality are arranged next to one another over the periphery of the duct through which flow occurs. A premixing zone (7) follows downstream of the inflow zone (5), into which premixing zone (7) a gaseous and/or liquid fuel (9) is injected as secondary flow into a gaseous main flow (4). Between premixing zone (5) and the downstream combustion zone (11), the transition is characterized by a jump (12) in cross-section which induces the initial cross-section of flow of the combustion zone (11). The fuel (9) is injected via a number of fuel lances (8) distributed over the periphery, the fuel (9) being enriched here with a portion of assisting air

11 Claims, 4 Drawing Sheets

COMBUSTION CHAMBER HAVING SELF-IGNITION

BACKGROUND OF THE INVENTION

1. Field of the Invention

The present invention relates to a combustion chamber having vortex generators in an inlet zone.

2. Discussion of Background

In burner configurations having a premixing section and a free outlet in the direction of outflow toward the downstream combustion space, there is frequently the problem of how to produce a stable flame front in the simplest manner at extremely low NOx, CO and UHC (=unsaturated hydrocarbons) emissions. Various proposals have already been disclosed in this regard but these are per se unsatisfactory. One exception among those disclosed hitherto is the invention disclosed in EP-A1-0 321 809, the proposals of which concerning the flame stabilization, the efficiency and the pollutant emissions, in particular the NOx emissions, represent an advance in quality. However, there are firing systems in which, for various reasons, the abovementioned subject matter of the invention cannot be used and, as a result, it is necessary in those cases to continue to operate with an obsolete technology, whether diffusion burners are used or whether vortex generators or flame retention baffles are added to the premixing section in the region of the flame front. In the first case, high NOx emissions must always be expected, the discharge quantity of which is no longer compatible with the more recent legal requirements in the countries which provide the most important markets; in the second case a flashback from the flame zone into the interior of the premixing section, especially along the inner wall, where, by the very nature of things, the flow velocity of the combustion air is relatively low, is still possible despite the installation of the proposed measures. A typical firing system in which the said techniques to prevent a flashback will inevitably fail is a combustion chamber designed for self-ignition. This is generally a largely cylindrical tube or an annular combustion chamber into which a working gas at a relatively high temperature flows and mixes there with an injected fuel, the fuel initiating self-ignition. The thermal preparation of the working gas to form hot gas takes place exclusively within this tube or this annular combustion chamber. If this is a secondary combustion chamber which acts between a high-pressure and a low-pressure turbine, space considerations alone make it impossible to fit premixing burners or provide means which would help to prevent a flashback and, for this reason, it has hitherto been necessary to forego this essentially attractive combustion technique. If the postulate extends to providing an annular combustion chamber as a secondary combustion chamber of a gas turbo group mounted on a shaft, additional problems connected with the flame stabilization arise with regard to minimizing the length of this combustion chamber.

SUMMARY OF THE INVENTION

Accordingly, one object of the invention as defined in the claims is to propose measures in the case of a combustion chamber of the type mentioned at the beginning which induce flame stabilization and minimize the pollutant emissions.

The combustion air for this combustion chamber is swirled via vortex generators in such a way that no recirculation areas occur in the premixing section in the wake of the said vortex generators. A fuel is fed into these extensive swirl structures. A fuel lance projecting into the duct is suitable for this purpose.

An essential advantage of the invention can be seen in the fact that the swirl flow originating from the vortex generators on the one hand provides for an extensive distribution of the fuel introduced; on the other hand, this turbulence brings about homogenization during the formation of the mixture from combustion air and fuel.

However, premixed fuel/air mixtures generally tend to self-ignite and accordingly tend to cause flashback. The advantage of the invention can be seen here in the fact that the fuel is injected behind a narrowing point in the premixing duct. This narrowing offers the advantage that the turbulence is reduced by increasing the axial velocity, which minimizes the risk of a flashback by the change in the turbulent flame speed.

Furthermore, the sojourn time to prevent self-ignition is reduced.

Furthermore, the extensive distribution of the fuel continues to be guaranteed, since the peripheral component of the swirl flow is not impaired.

After the narrowing point in the premixing duct, the axial component is reduced again by the opening taking place there; the advantage of this can be seen in the fact that the now increasing turbulence provides for homogeneous mixing.

Taking place on the outflow side of the premixing duct is a widening in cross-section, the size of which produces the actual cross-section of flow of the combustion space or of the combustion zone. Forming inside this widening of cross-section during operation are marginal zones in which vortex separations, i.e. vortex rings, arise due to the vacuum caused there by the flow, which vortex separations lead in turn to stabilization of the flame front. This configuration is particularly advantageous where the combustion chamber is designed for self-ignition. This is because such a combustion chamber preferably has essentially the form of an annular or ring-shaped combustion chamber and is of short axial overall length and has a working gas at high temperature flowing through it at high velocity. The said peripheral vortex separations stabilize the flame front in such a way that additional precautions against a flashback of the flame are no longer required.

Advantageous and expedient further developments of the achievement of the object according to the invention are defined in the further, dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
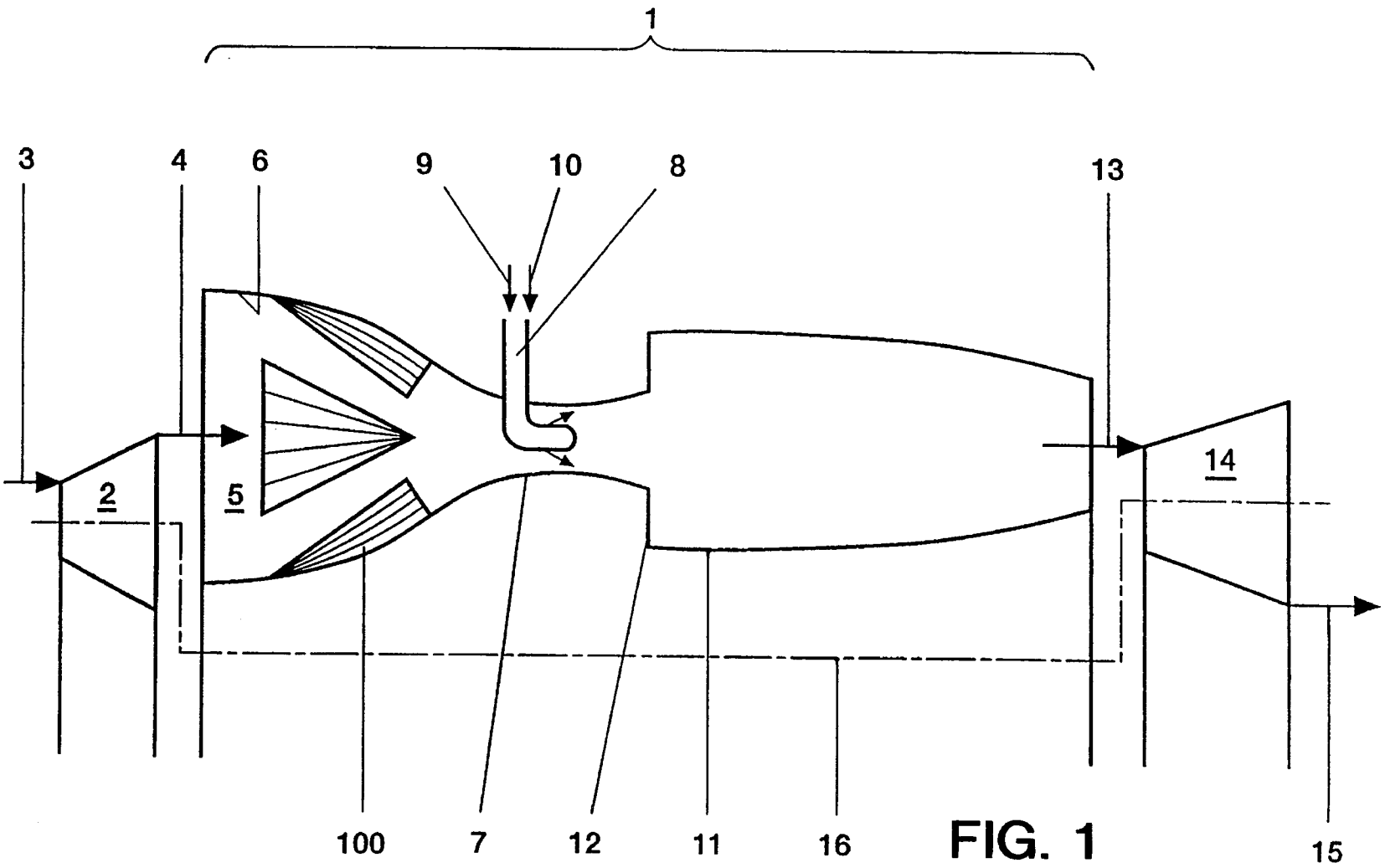
FIG. 1 shows a self-igniting combustion chamber, conceived as an annular combustion chamber.

Referring now to the drawings, wherein like reference numerals designate identical or corresponding parts throughout the several views, all elements not essential for directly understanding the invention have been omitted and the direction of flow of the media is indicated by arrows, in FIG. 1 an annular combustion chamber 1 is shown, as apparent from the shaft axis 16, which essentially has the form of a continuous, annular or quasi-annular cylinder. In addition, such a combustion chamber can also consist of a number of axially, quasi-axially or helically arranged and individually self-contained combustion spaces. Such annular combustion chambers are especially suitable for being operated as self-igniting combustion chambers which are placed in the direction of flow between two turbines mounted on one shaft. If such an annular combustion chamber 1 is operated for self-ignition, the turbine 2 acting upstream is only designed for partial expansion of the hot gases 3, whereby the exhaust gases 4 downstream of this turbine 2 still flow at a fairly high temperature into the inflow zone 5 of the annular combustion chamber 1. This inflow zone 5 is fitted on the inside and in the peripheral direction of the duct wall 6 with a number of vortex-generating elements 100, simply called vortex generators below, which will be discussed in more detail further below. The exhaust gases 4 are swirled by the vortex generators 100 in such a way that no recirculation areas occur in the wake of the said vortex generators 100 in the following premixing section 7. A plurality of fuel lances 8 are disposed in the peripheral direction of this premixing section 7 designed as a venturi duct, which fuel lances 8 assume the function of supplying a fuel 9 and assisting air 10. These fuel lances 8 will be discussed in more detail further below. These media can be supplied to the individual fuel lances 8, for example, via a ring main (not shown). The swirl flow initiated by the vortex generators 100 provides for extensive distribution of the fuel 9 introduced, and also of the admixed assisting air 10 if need be. Furthermore, the swirl flow provides for homogenizing of the mixture of combustion air and fuel. The fuel 9 injected by the fuel lance 8 into the exhaust gases 4 initiates self-ignition provided these exhaust gases 4 have the specific temperature which is capable of initiating the fuel-dependent self-ignition. If the annular combustion chamber is operated with a gaseous fuel, the exhaust gases 4 must be at a temperature greater than 850° C. for initiating a self-ignition. As already recognized above, there is the potential risk of flashback during such combustion. This problem is removed on the one hand by designing the premixing zone 7 as a venturi duct and on the other hand by the injection of the fuel 9 being disposed in the region of the greatest contraction in area in the premixing zone 7. Due to the narrowing in the premixing zone 7, the turbulence is reduced by the increase in the axial velocity, which minimizes the risk of flashback by the reduction in the turbulent flame speed. On the other hand, the extensive distribution of the fuel 9 is still guaranteed, since the peripheral component of the swirl flow originating from the vortex generators 100 is not impaired. A combustion zone 11 follows behind the premixing zone 7, which is kept relatively short. The transition between the two zones is formed by a radial jump 12 in cross-section, which first of all induces the cross-section of flow of the combustion zone 11. A flame front also appears in the plane of the jump 12 in cross-section. In order to avoid a flashback of the flame into the interior of the premixing zone 7, the flame front must be kept stable. For this purpose, the vortex generators 100 are designed in such a way that no recirculation takes place in the premixing zone 7; only after the sudden widening of the cross-section is the breakdown of the swirl flow desired. The swirl flow helps to reestablish rapidly the flow behind the jump 12 in cross-section so that high burn-out at short overall length can be achieved by as far as possible complete utilization of the volume of the combustion zone 11. A marginal flow zone forms inside this jump 12 in cross-section during operation, in which marginal flow zone vortex separations occur due to the vacuum prevailing there, which vortex separations then lead to stabilization of the flame front. The exhaust gases 4 prepared in the combustion zone 11 to form hot gases 13 then act on a turbine 14 acting further downstream. The exhaust gases 15 can then be used to operate a steam circuit, the system in the last-mentioned case then being a combined system.

Figure 2:
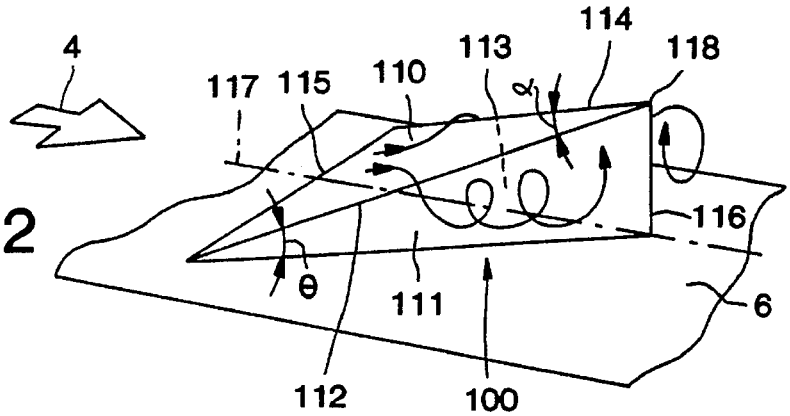
FIG. 2 shows a perspective representation of the vortex generator.
Figure 3:
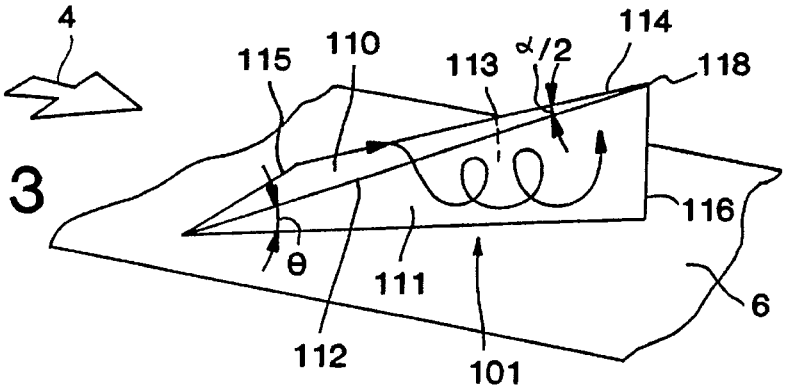
FIG. 3 shows an embodiment variant of the vortex generator.
Figure 4:
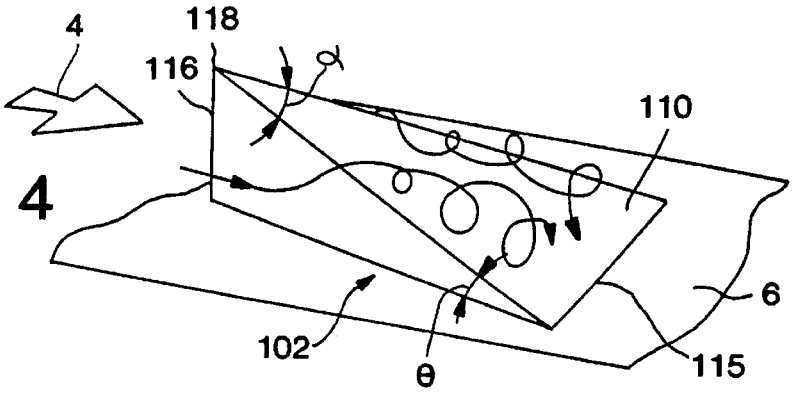
FIG. 4 shows an arrangement variant of the vortex generator according to FIG. 3.

The actual inflow zone 5 is not shown in FIGS. 2, 3 and 4. However, the flow of the exhaust gases 4 is shown by an arrow, whereby the direction of flow is also predetermined. According to these figures, a vortex generator 100, 101, 102 essentially consists of three triangular surfaces around which flow freely occurs. These are a top surface 110 and two side surfaces 111 and 113. In their longitudinal extent, these surfaces run at certain angles in the direction of flow. The side walls of the vortex generators 100, 101, 102, which preferably consist of right-angled triangles, are fixed, preferably gastight, with their longitudinal sides to the duct wall 6 already discussed. They are oriented in such a way that they form a face at their narrow sides while enclosing an angle $\alpha$ of sweepback. The face is embodied as a sharp connecting edge 116 and is perpendicular to every duct wall 6 with which the side surfaces are flush. The two side surfaces 111, 113 enclosing the angle $\alpha$ of sweepback are symmetrical in form, size and orientation in FIG. 4, and they are arranged on either side of an axis 117 of symmetry which is equidirectional to the duct axis.

With a very narrow edge 115 running transversely to the duct through which flow occurs, the top surface 110 bears against the same duct wall 6 as the side surfaces 111, 113. Its longitudinally directed edges 112, 114 are flush with the longitudinally directed edges, projecting into the flow duct, of the side surfaces 111, 113. The top surface 110 runs at an angle $\theta$ of incidence to the duct wall 6, the longitudinal edges 112, 114 of which form a point 118 together with the connecting edge 116. The vortex generator 100, 101, 102 can of course also be provided with a base surface with which it is fastened to the duct wall 6 in a suitable manner. However, such a base surface is in no way connected with the mode of operation of the element.

The mode of operation of the vortex generator 100, 101, 102 is as follows: when flow occurs around the edges 112 and 114, the main flow is converted into a pair of oppositely directed vortices, as shown schematically in the figures. The vortex axes lie in the axis of the main flow. The swirl number and the location of the vortex breakdown, provided the latter is intended, are determined by corresponding selection of the angle $\theta$ of incidence and the angle $\alpha$ of sweepback. The vortex intensity and the swirl number increase as the angles increase, and the location of the swirl breakdown is displaced upstream right into the region of the vortex generator 100, 101, 102 itself. Depending on the use, these two angles θ and α are predetermined by design factors and by the process itself. These vortex generators need only be adapted in respect of length and height, as will be dealt with in more detail further below with reference to FIG. 5.

In FIG. 2, the connecting edge 116 of the two side surfaces 111, 113 forms the downstream-side edge of the vortex generator 100. The edge 115 of the top surface 110 running transversely to the duct through which flow occurs is therefore the edge acted upon first by the duct flow.

FIG. 3 shows a so-called "half vortex generator" on the basis of a vortex generator according to FIG. 2. In the vortex generator 101 shown here, only one of the two side surfaces is provided with the angle α/2 of sweepback. The other side surface is straight and is oriented in the direction of flow. In contrast to the symmetrical vortex generator, only one vortex is produced here on the side having the arrow, as symbolized in the figure. Accordingly, there is no vortex-neutral field downstream of this vortex generator; on the contrary, a swirl is imposed on the flow.

FIG. 4 differs from FIG. 2 in as much as the sharp connecting edge 116 of the vortex generator 102 is here that point which is acted upon first by the duct flow. The element is accordingly turned through 180°. As apparent from the representation, the two oppositely directed vortices have changed their direction of rotation.

Figure 5:
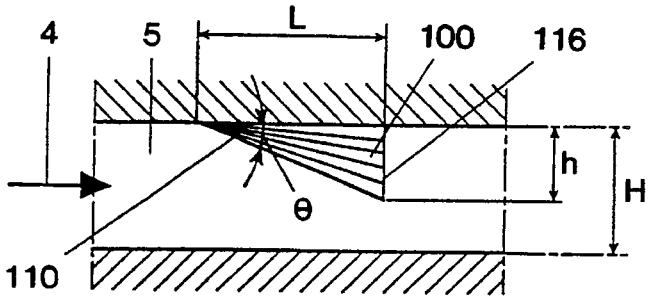
FIG. 5 shows a vortex generator in the premixing duct.

FIG. 5 shows the basic geometry of a vortex generator 100 installed in a duct 5. As a rule, the height h of the connecting edge 116 will be coordinated with the duct height H or the height of the duct part which is allocated to the vortex generator in such a way that the vortex produced already achieves such a size directly downstream of the vortex generator 100 that the full duct height H is filled by it. This leads to a uniform velocity distribution in the cross-section acted upon. A further criterion which can influence the ratio of the two heights h/H to be selected is the pressure drop which occurs when the flow passes around the vortex generator 100. It goes without saying that the pressure loss factor also increases at a greater ratio of h/H.

The vortex generators 100, 101, 102 are mainly used where it is a matter of mixing two flows with one another. The main flow 4 in the form of combustion air attacks the transversely directed edge 115 or the connecting edge 116 respectively in the arrow direction. The secondary flow in the form of a gaseous and/or liquid fuel, which if need be is enriched with a portion of assisting air (cf. FIG. 13), has a substantially smaller mass flow than the main flow. In the present case, this secondary flow is directed downstream of the vortex generator into the main flow, as is particularly apparent from FIG. 1.

In the example shown according to FIG. 1, four vortex generators 100 are distributed at a distance apart over the periphery of the duct 5. The vortex generators can of course also be joined in sequence in the peripheral direction in such a way that no clear gaps are left at the duct wall 6. The vortex to be produced is ultimately decisive for the selection of the number and arrangement of the vortex generators.

FIGS. 6 to 12 show further possible forms of the introduction of the fuel into the combustion air 4. These variants can be combined with one another and with a central fuel injection in a variety of ways, as apparent, for example, from FIG. 1.

Figure 6:
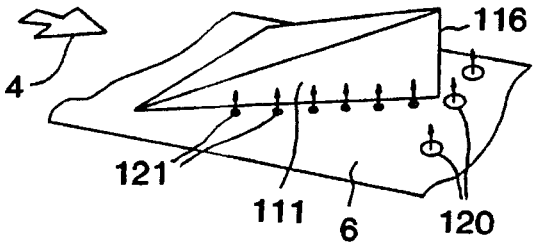
FIGS. 6–12 show variants of the fuel supply in connection with vortex generators.

In FIG. 6, the fuel, in addition to being injected via duct wall bores 120 located downstream of the vortex generators, is also injected via wall bores 121 which are located directly next to the side surfaces 111, 113 and in their longitudinal extent in the same duct wall 6 on which the vortex generators are arranged. The introduction of the fuel through the wall bores 121 gives the vortices produced an additional impulse, which prolongs the life of the vortex generator.

Figure 7:
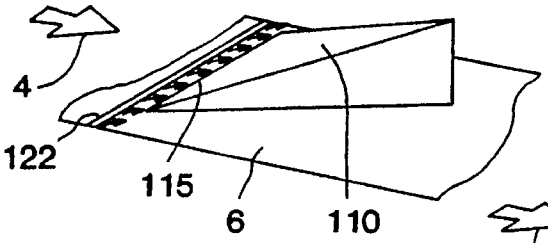
Figure 8:
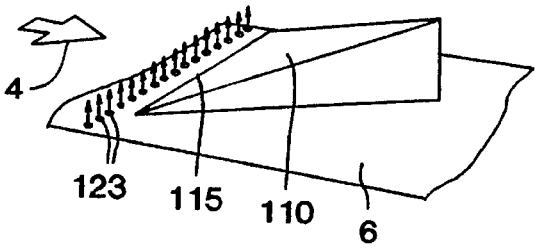

In FIGS. 7 and 8, the fuel is injected via a slot 122 or via wall bores 123, both arrangements being located directly in front of the edge 115 of the top surface 110 running transversely to the duct through which flow occurs and in their longitudinal extent in the same duct wall 6 on which the vortex generators are arranged. The geometry of the wall bores 123 or of the slot 122 is selected in such a way that the fuel is fed at a certain injection angle into the main flow 4 and, as a protective film, largely screens the subsequently placed vortex generator from the hot main flow 4 by flowing around it.

In the examples described below, the secondary flow (cf. above) is first of all directed via guides (not shown) through the duct wall 6 into the hollow interior of the vortex generators. An internal cooling means for the vortex generators is thus provided without having to provide further measures.

Figure 9:
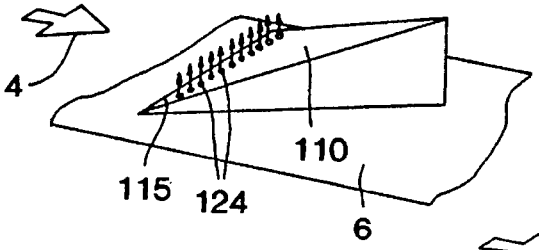

In FIG. 9, the fuel is injected via wall bores 124 which are located inside the top surface 110 directly behind and along the edge 115 running transversely to the duct through which flow occurs. The cooling of the vortex generator is effected here externally rather than internally. The issuing secondary flow, when flowing around the top surface 110, forms a protective layer screening the latter from the hot main flow 4.

Figure 10:
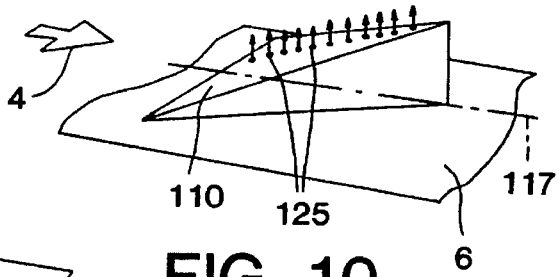

In FIG. 10, the fuel is injected via wall bores 125 which are arranged in an echelon within the top surface 110 along the line 117 of symmetry. With this variant, the duct walls 6 are protected especially effectively from the hot main flow 4, since the fuel is introduced first of all at the outer periphery of the vortices.

Figure 11:
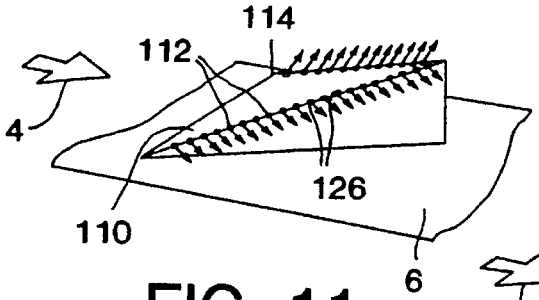

In FIG. 11, the fuel is injected via wall bores 126 which are located in the longitudinally directed edges 112, 114 of the top surface 110. This solution guarantees effective cooling of the vortex generators, since the fuel issues at its extremities and thus passes completely around the inner walls of the element. The secondary flow is fed here directly into the developing vortex, which leads to defined flow relationships.

Figure 12:
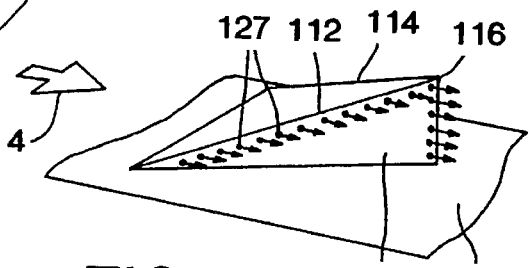

In FIG. 12, the fuel is injected via wall bores 127 which are located in the side surfaces 111 and 113, on the one hand in the region of the longitudinal edges 112 and 114, and on the other hand in the region of the connecting edge 116. This variant has a similar action to that in FIG. 6 (bores 121) and in FIG. 11 (bores 126).

Figure 13A:
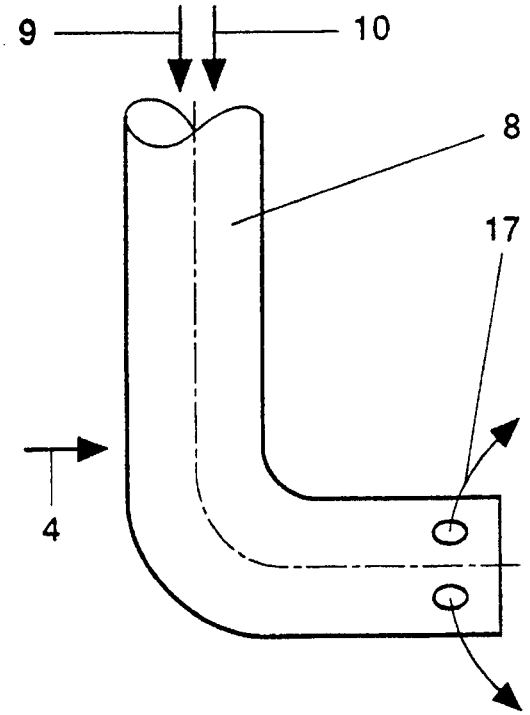
FIG. 13A and 13B are side and front views of an embodiment of a lance for injecting fuel and assisting air, in the direction of the oncoming flow and as viewed from the front.
Figure 13B:
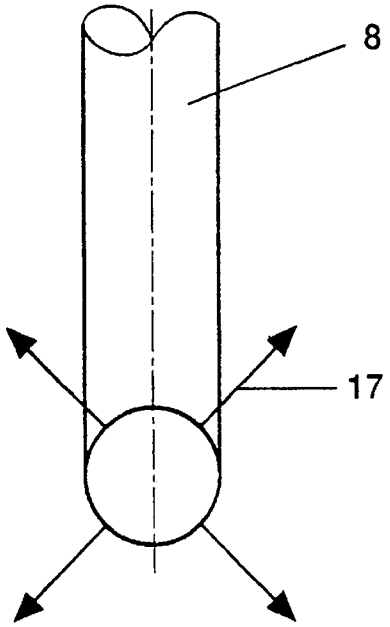

In FIG. 13A and 13B show an embodiment of a fuel lance 8 in the direction 4 of oncoming flow and from the front. This lance is designed for central fuel injection. It is dimensioned for about 10% of the total volumetric flow through the duct, the fuel 9 being injected transversely to the direction of flow. Longitudinal injection of the fuel in the direction of flow can of course also be provided. In this case, the injection impulse corresponds approximately to that of the main flow. The injected fuel 9 is entrained in conjunction with a portion of assisting air 10 via a plurality of radial openings 17 by the vortices initiated upstream and is mixed with the main flow 4. The injected fuel 9 follows the helical course of the vortices (cf. FIGS. 2–4) and is finely distributed in a uniform manner downstream of the vortices in the chamber. This reduces the risk of impact jets on the opposite duct wall as well as the formation of so-called hot spots, as is the case in non-turbulent flow. Since the main mixing process takes place in the vortices and is largely insensitive to the injection impulse of the secondary flow, the fuel injection can be kept flexible and can be adapted to other boundary conditions. Thus the same injection impulse can essentially be retained over the entire load range, and in this respect reference is made to the comments relating to FIG. 14 for the sake of completeness. Accordingly, since the mixing quality is determined largely by the geometry of the vortex generators, action has to be taken in the fuel injection if need be only in the transient region. By the combustion process being optimized by adapting the ignition delay time of the fuel 9 to the mixing time of the vortices, general minimizing of the pollutant emissions is guaranteed. Furthermore, it should be emphasized that, in connection with the description of the vortex generators with reference to FIGS. 2 to 4, the intensive mixing produces a good temperature profile over the entire cross-section through which flow occurs, which reduces the occurrence of thermoacoustic instabilities. Thus the vortex generators, considered by themselves, act as a damping measure against thermoacoustic vibrations. Furthermore, the fuel lance has the supply, already referred to briefly, of the assisting air 10. This type of operation is dealt with in more detail below.

Figure 14:
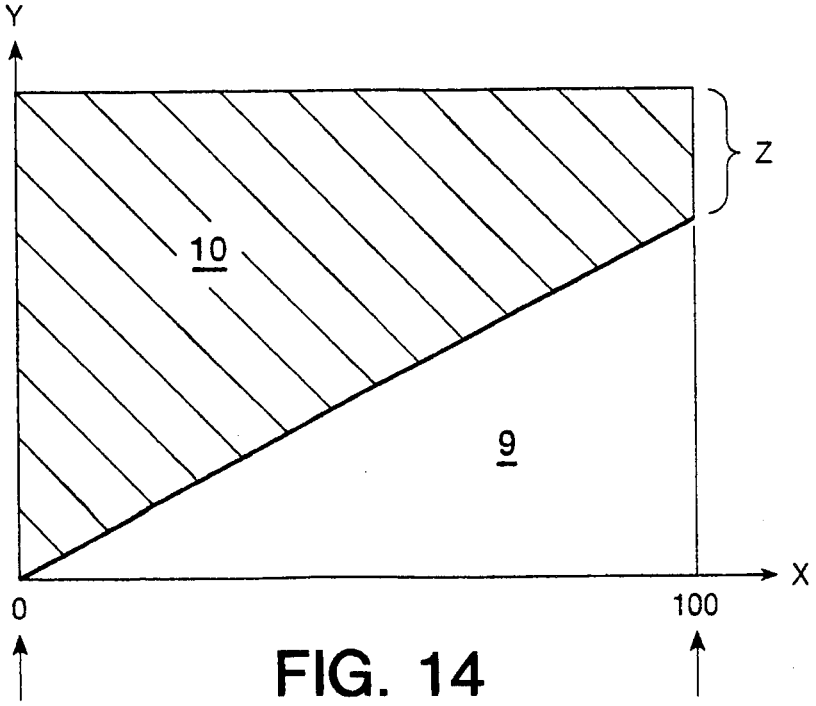
FIG. 14 shows a starting diagram of the combustion chamber with regard to the interdependence between fuel and assisting air.

FIG. 14 shows a scheme which relates to the supply of fuel 9 and assisting air 10 and according to which the combustion chamber described is started. Here, during the start-up, it is a matter of producing those conditions which guarantee optimum mixing of the injected fuel relative to the main flow, that is, optimum ignition behavior and optimum combustion in the transient region right up to full load of the combustion chamber. The ordinate Y shows the quantity of injected media relative to one another, and the abscissa X shows the load of the system. It is apparent that the quantity of assisting air 10 is at a maximum during the start; it decreases successively with increasing load of the combustion chamber, while the injected fuel 9 gradually increases. At full load, the fuel 9 still has a portion Z of assisting air 10. The advantage of this procedure can be seen in the fact that the assisting air is highly suitable for absorbing flexions of the fuel impulse, which impair the mixing. Furthermore, sudden changes in the fuel impulse lead to thermoacoustic instabilities inside the combustion chamber. This is prevented by a constant supply of a minimum portion Z of assisting air 10.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A combustion chamber for self-ignition of a fuel, comprising:

an inflow duct for a main gaseous flow;

a premixing duct downstream of and in fluid communication with the inflow duct;

a combustion duct downstream of and in fluid communication with the premixing duct, wherein the inflow duct, premixing duct and combustion duct are aligned on an axial direction of flow;

a plurality of vortex generators mounted adjacent one another about a periphery of the inflow duct;

a fuel nozzle for injecting into the premixing duct at least one of a gaseous and liquid fuel as a secondary flow into the gaseous main flow;

wherein the premixing duct is venturi-shaped and the fuel nozzle is positioned to inject fuel in a minimum cross sectional flow area of the premixing duct, and wherein a radially outward portion of the combustion duct forms a jump connecting the premixing duct and the combustion duct, the combustion duct having a greater cross sectional flow area than the premixing duct.

2. The combustion chamber as claimed in 1, wherein the fuel nozzle includes means for adding a portion of assisting air to the fuel.

3. The combustion chamber as claimed in claim 1, wherein the combustion chamber is formed as an annular combustion chamber.

4. The combustion chamber as claimed in claim 1, wherein each vortex generator comprises a body having three surfaces around which flow occurs freely and which extend longitudinally in the direction of flow, wherein a first surface forms a top surface and a second and third surface form side surfaces, wherein the side surfaces are mounted with one edge flush on a wall segment in the inflow duct and positioned at an acute angle relative to one another, wherein the top surface includes an edge oriented transversely to the flow direction and positioned in contact with the wall segment on which the side surfaces are mounted, and wherein longitudinally directed edges of the top surface are joined flush with longitudinally directed edges of the side surfaces projecting into the duct and the top surface is oriented at a predetermined angle of incidence to the wall segment.

5. The combustion chamber as claimed in claim 4, wherein the two side surfaces are arranged symmetrically about an axis of symmetry.

6. The combustion chamber as claimed in claim 4, wherein the two side surfaces are joined at a connecting edge and the connecting edge and the longitudinally directed edges of the top surface meet at a point, and wherein the connecting edge is perpendicular to the wall segment of the inflow duct.

7. The combustion chamber as claimed in claim 6, wherein at least one of the connecting edge and the longitudinally directed edges of the top surface are shaped to be sharp.

8. The combustion chamber as claimed in claim 6, wherein an axis of symmetry of the vortex generator is oriented parallel to a longitudinal inflow duct axis, the connecting edge of the two side surfaces forms the downstream edge of the vortex generator, and wherein the edge of the top surface oriented transversely to the inflow duct is the upstream edge acted upon first by the gaseous main flow.

9. The combustion chamber as claimed in claim 6, wherein a ratio of a height of the vortex generator at the connecting edge to a height of the inflow duct is selected so that a vortex produced fills the height of the inflow duct and a height of the duct part directly downstream of the vortex generator.

10. The combustion chamber as claimed in claim 1, wherein the fuel injector includes means for injecting a fuel in a direction of the gaseous main flow.

11. The combustion chamber as claimed in claim 10, wherein the fuel injector includes means for injecting a fuel in a direction transverse to the gaseous main flow.

* * * * *